United States Patent [19]

Zimmer

[11] 3,984,095

[45] Oct. 5, 1976

[54] SHEET SEPARATOR

[75] Inventor: Robert E. Zimmer, Niles, Ill.

[73] Assignee: Addressograph Multigraph Corporation, Cleveland, Ohio

[22] Filed: Aug. 21, 1975

[21] Appl. No.: 606,661

[52] U.S. Cl. ..... 271/121; 271/35

[51] Int. Cl.[2] ..... B65H 3/52

[58] Field of Search ..... 271/35, 121, 124, 125, 271/137

[56] References Cited

UNITED STATES PATENTS

| | | | |
|---|---|---|---|
| 2,635,874 | 4/1953 | LaBore | 271/35 |
| 3,656,821 | 4/1972 | McCloskey | 308/72 |
| 3,869,117 | 3/1975 | Yoshimura | 271/35 X |
| 3,874,652 | 4/1975 | Bilbrey | 271/124 X |

*Primary Examiner*—Richard A. Schacher
*Attorney, Agent, or Firm*—Russell L. Root

[57] ABSTRACT

Sheet separating apparatus for separating the bottom sheet from a sheet stack while at the same time adapted to adjust to any non-uniformity in thickness of portions of the sheet as each sheet enters a nip between a friction member and a sheet conveyor of substantial breadth. The sheet separating apparatus includes a broad friction member which is biased toward engagement with a broad, load distributing conveyor which transports the sheet material. The friction member is supported in such a manner that it can tilt about an axis which is parallel to the sheet path, and thus adjust itself in accordance with any variations in thickness of that portion of the sheet which the conveyor encounters as it enters the nip between the friction member and the conveyor. This arrangement causes a uniform pressure to be generated by the various portions of the friction member upon the various portions of the conveyor, and thereby to have a more uniform effect upon the portions of the sheets as they enter the nip.

10 Claims, 3 Drawing Figures

SHEET SEPARATOR

BACKGROUND OF THE INVENTION

This application relates to feeding of sheet material, and particularly to apparatus for separating sheets which are intentionally or inadvertently superimposed upon one another. Known apparatus for separating such sheet material may be found in U.S. Pat. No. 3,831,928.

As shown by the aforesaid patent, it is known to separate superimposed sheets of a sheet stack by feeding the sheet stack into the nip between a conveyor belt with a high coefficient of friction with respect to the sheet material and a friction member. The friction member engages the edge of the stack of sheets, and the coefficient of friction between the friction member and the sheet material is less than that between the conveyor and the sheet material, as well as being higher than the coefficient of friction between the sheets of the stack, so that only the bottom sheet is fed forward.

The friction member is mounted for movement towards and away from the surface of the conveyor and is urged toward engagement with the sheet conveyor. Such types of sheet separating apparatus as satisfactory in the cases where sheets having substantially uniform thickness across their width enter the nip between the friction member and the conveyor with their leading edges substantially parallel to the front edge of the friction member. In fact, however, especially where documents are being fed to a copier for example, a sheet so entering a separator may not always be of uniform thickness across its width since sheets may be dog-eared and have doubled portions or the like. Nor will the sheet always enter the nip between the conveyor and the friction member with its leading edge exactly parallel to the front edge of the friction member.

An additional drawback to known sheet feeding and separating apparatus is that in providing for the necessary degree of frictional engagement between the friction member and the sheet material it has been necessary to bias the friction member in such a manner that when no sheet is passing thereunder the friction member is urged into contact with the moving conveyor belt. This means that as the sheet material is separated and the last sheet passes the frictiion member the friction member is in frictional engagement with the conveyor belt. In practice, it has been found that this tends to place a highly undesirable retarding load on the mechanism which drives the conveyor, and to subject the conveyor belts to possible chattering and erratic feeding motion, and the friction member as well as the belts to undue wear.

SUMMARY OF THE PRESENT INVENTION

According to the present invention there is provided a sheet separating apparatus which is extremely efficient at separating superimposed sheets while at the same time adapted to adjust to any non-uniformity of sheet orientation or thickness as the sheet enters the nip between a friction member and a sheet conveyor.

According to the invention a broad sheet separator includes a friction member having a friction surface for engaging the lead edge of a sheet stack. The friction surface is movable toward and away from the surface of a broad conveyor which transports the sheet stack and is biased toward engagement with the conveyor, thus forming a nip toward which the sheet stack is fed. The friction member is supported in such a manner that it can tilt about an axis which is parallel to the sheet path, and thus adjust itself into precise parallelism with the conveyor surface or a sheet lying thereon, thereby accommodating any variations in thickness across the width of a sheet as it enters the nip between the friction member and the conveyor, thereby maintaining an equal pressure upon all portions of the sheet between itself and the conveyor surface.

In an additional aspect of the present invention there is provided a sheet separating apparatus which provides a conveyor and a friction member which are biased toward frictional engagement with one another to provide for separating of stacked sheet material but which also minimizes the likelihood of a retarding force of undesirable proportions being placed on the belt conveyor once the separated sheets have left the separator. This is accomplished by a novel conveyor including a plurality of parallel belts, some of which are of high friction coefficient material, and others of lower friction coefficient material so as to provide a mean frictional effect adequate to drive the sheets through the nip, and yet not of such character as to drag excessively against the friction member when the last sheet has passed through.

BRIEF DESCRIPTION OF THE DRAWINGS

Other objects and advantages of the present invention become further apparent from the following specification and the accompanying drawings wherein.

DETAILED DESCRIPTION OF THE PREFERRED EMBODIMENT

As set forth above, the present invention relates to the separating of stacked overlapped sheets being conveyed along a sheet-feed path. It is contemplated that the principles of this invention may be practiced in connection with sheets which are manually or automatically fed onto the means which transports the sheet material along the sheet-feed path. For purposes of illustration, the remaining disclosure relates to the present invention as applied to sheet material fed onto a conveyor for subsequent separation. Also, the term "stacked sheets" is intended to refer to superimposed sheets which are in either overlapped or edgewise aligned relation.

Figure 1:
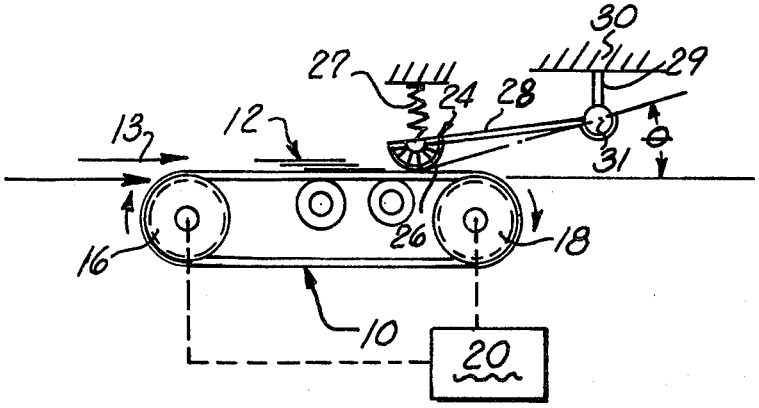
FIG. 1 is a diagrammatic side elevation of sheet separating apparatus according to the present invention.
Figure 2:
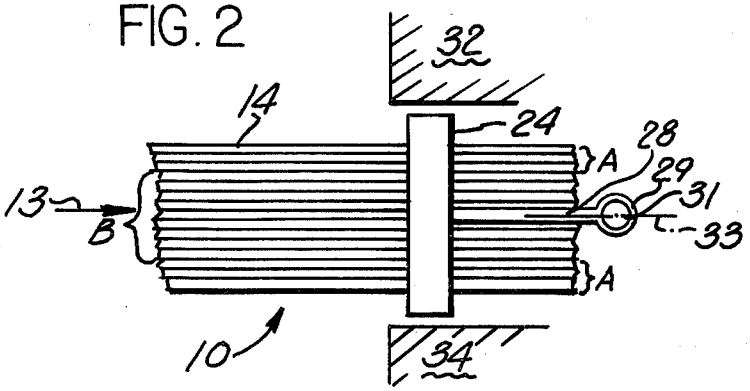
FIG. 2 is a top plan view of the apparatus of FIG. 1 with portions omitted.

Referring to FIGS. 1 and 2, there is disclosed a sheet conveyor 10 for feeding stacked sheets 12 along a sheet-feed path labeled by the arrow 13. The sheet conveyor 10 comprises a plurality of belts 14 entrained about a pair of sheaves 16, 18. Conventional driving apparatus 20 is provided for positively driving the sheaves 16, 18 at a predetermined rate.

The conveyor 10 is fairly broad, for example in the form shown it presents a relatively continuous surface of about two inches in breadth, and is made up of fifteen parallel O-ring belts 14 trained about the sheaves 16, 18. The conveyor 10 must have a relatively high friction coefficient with paper since it must force the bottom sheet of a stack through the separating nip, and for this reason the belts 14 are made of material selected to provide the desired friction coefficient.

As shown in FIGS. 1 and 2, the sheet separator includes a friction member 24 having a surface 26 which has a high coefficient of friction. The member 24 is schematically represented in FIGS. 1 and 2, but it should be clear to those of ordinary skill in the art that such a member can be formed in any suitable manner. The effect of gravity on the member 24 biases it toward engagement with the conveyor 10. Preferably, however, the member 26 is also urged by light spring pressure against the conveyor 10. FIG. 1 shows diagrammatically a spring 27 whose force can be adjusted; e.g.; by positioning the spring perch, to empirically set the pressure for best operation. The friction member 24 and the upper surface of the conveyor 10 form a nip between which the bottom sheet of a stack can pass.

As seen in FIG. 2, the friction member 24 extends substantially transverse to the sheet-feed path 13 and has a breadth comparable to that of the conveyor 10. For supporting the friction member 24 there is provided a support arm 28 having a first end connected to the friction member 24. The other end of the support arm is so shaped as to provide a universal connection with the post 29 projecting from the fixed support 30. However, since it is not desirable that the arm 28 pivot about a vertical axis there are provided a pair of fixed side limit members 32, 34 which restrict such form of pivotal movement.

The universal mounting of the friction member 24 does permit the member to move bodily up and down and also to tilt about an axis 33 which extends parallel to the feed path and which lies in a plane substantially normal to the feed path and which lies in a plane substantially normal to the conveyor surface and extending through the support arm. This permits the member 24 to tilt or pivot in order to compensate for various discrepancies in sheet thickness or orientation as the bottom sheet is engaged in the nip between the weighted friction member 24 and the conveyor 10, and to equalize the pressure at all points across the conveyor. The angle $\theta$ shown in FIG. 1, is selected so as to control the degree of self energization contributing to the downward force of the retard member, and has been found to be most effective at about 17° for the particular design of machine presently in use.

Figure 3:
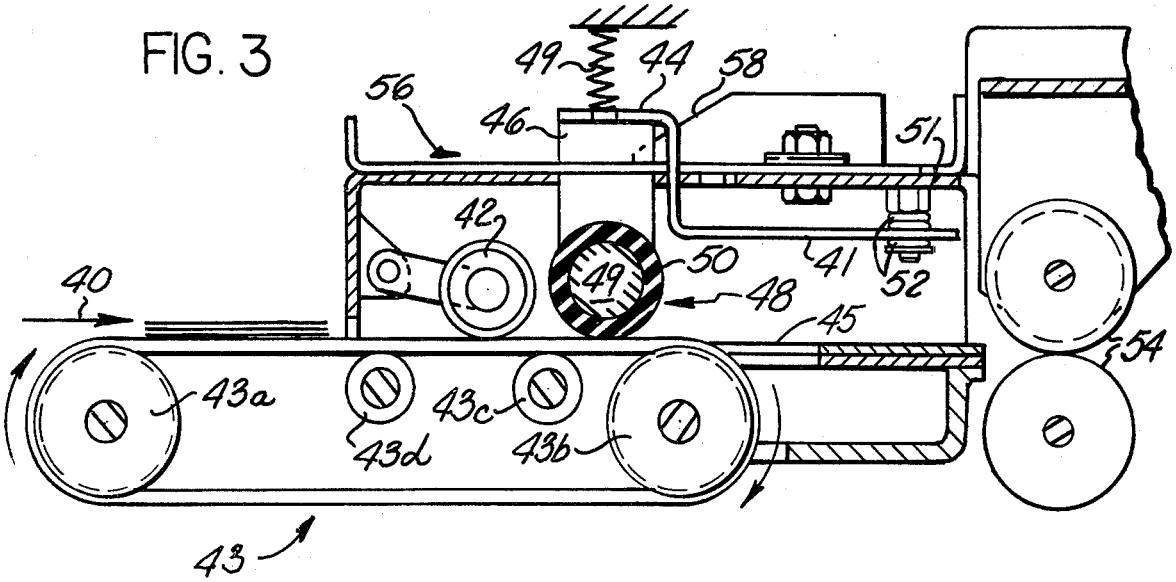
FIG. 3 is a side elevation of a form of apparatus in accordance with the present invention, as actually constructed.

FIG. 3 is an example of a sheet separator in accordance with the principle illustrated in FIGS. 1 and 2, and showing details of the device substantially as presently constructed. In FIG. 3 the sheet-feed path is represented by the arrow 40. In this embodiment there is provided a weighted roller 42 upstream of the sheet separator for insuring a driving contact between a sheet or a sheet stack and the conveyor as the sheet or sheet stack is fed into the nip of the sheet separator and the conveyor. The conveyor 43 is shown as comprising parallel rubber O-ring belts trained around sheaves **43*a* and 43*b*. Back-up rollers 43*c* and 43*d* support the stack of sheets, and roller 43*c* especially prevents undue deflection of the belts adjacent the sheet separation point. The arrangement is analogous to that of the belts 14 of conveyor 10 as seen in FIG. 2. It will be noted also that the upper surface of the belts is slightly higher than the main support surface 45** for the sheets.

A single support arm 41 is centrally connected to an inverted U-shaped frame 44. The frame 44 extends transversely of the sheet-feed path and includes a pair of downwardly depending ears 46 each of which nonrotatably supports an end of a cylindrical friction member 48. Preferably, friction member 48 comprises an inner aluminum cylinder 49 surrounded by a sleeve 50 which is formed of a material of high frictional coefficient, such as neoprene rubber. While neoprene rubber is, in general, understood to be a relatively high friction material, the rubber of sleeve 50 is of a harder composition and has, of course, a friction coefficient with paper somewhat less than that of the surface of conveyor 43.

To bias the friction member 48 toward engagement with the conveyor there is provided spring means, represented schematically at 49 in FIG. 3 which applies a force to the frame 44 for urging the friction member 48 toward engagement with conveyor 43. It will be readily apparent to those of ordinary skill in the art that there are numerous ways to employ weight and/or spring means for biasing the friction member toward engagement with the conveyor in the proper degree.

In the embodiment of FIG. 3, the other end of the support arm 41 has a circular opening which encircles a fixed cylindrical shaft 51. The circular opening has a diameter greater than the shaft so as to act as a universal joint. A series of O-rings 52 help to permit the universal motion but snub out any undue play which might result from the oversize hole. The difference in diameters of the support shaft 51 and the circular opening in the support arm 41 is sufficient to permit the support arm to tilt in a universal manner as indicated in FIG. 1 in order to provide uniform pressure across the conveyor and to compensate for varying sheet thickness variations due to folded corners or orientation. While the single arm universal mounting, as shown, is presently preferred, it will be appreciated that the universal motion required can be provided in other ways; e.g., by independent parallel support links with loose connections.

As shown in FIG. 3, there is further provided a slidable member 56 which includes a camming surface 58. The member 56 may be manually slid so that the camming surface engages the frame 44 and lifts the friction member out of engagement with the conveyor. This feature is utilized when single sheets are being fed along the conveyor and there is no need for separating a sheet from a stack.

In the operation of the separator when a sheet stack approaches the nip between the friction member and the conveyor, the friction member retards the movement of all but the lowermost sheet of the sheet stack. The conveyor has a higher frictional driving engagement with the lowest sheet than does the friction sleeve 50, thereby driving the lowermost sheet through the nip. The conveyor can thereby sequentially engage and drive each bottom sheet of the stack in turn through the nip, while the friction member prevents movement of all but the lowermost sheet of the stack. Once the last sheet is engaged by the conveyor, it is driven because of the higher coefficient of friction of the conveyor in relation to the friction member, and is propelled forceably into the nip due to the grip of the weighted roller 42.

It will be understood, of course, that the sheaves 16, 18 or **43*a*, 43*b*, are connected with their drives by means of an overrunning clutch (not shown) in a conventional manner so that, as the lead edge of the bottom sheet reaches the nip of the rollers 54**, it can be taken away at a speed higher than that of the normal conveyor speed.

As stated above, the present invention also provides a novel conveyor belt arrangement for providing high frictional drive contact with the sheet stack while minimizing drag on the driving mechanism. Referring to FIG. 2, the belts form a conveyor width which is preferably great enough to span about two inches of the center of the bottom sheet. This distributes the loading so as to minimize local pressure between the sheet and the conveyor or between the friction sleeve 50 and the conveyor in the absence of a sheet.

Once the optimum material for the friction sleeve 50 is selected to provide the appropriate retarding action, minimum wear, etc., the next consideration is to provide appropriate frictional characteristics for the belts making up the conveyor 43, which must have a slightly higher coefficient of friction with paper than the coefficient for the sleeve 50 in order to insure separation.

In accordance with the present invention, since materials of the precise coefficient most desirable are not usually available except by special order, this object is achieved by acquiring O-ring belts of various readily available materials and combining the belts in various proportions. For example, in the particular construction illustrated, belts of standard high friction neoprene and standard low friction silicone rubber were selected and the belts were mixed in a ratio which would provide a mean friction effect approximating that desired. It turned out, in the exemplary case, that six high friction neoprene belts and nine silicone rubber belts would provide this result. These can be arranged in any order on the sheaves, but a slight advantage appears to exist if the high friction belts are at the outer margins of the conveyor. Accordingly, the belts were arranged as indicated in FIG. 2 wherein A represents the neoprene belt zones, and B the zone of silicone rubber belts.

With the arrangement as above-described, the conveyor has a sufficient coefficient of friction with paper to overcome the effect of the friction member 48 and drive the sheet through the separating nip. The effective friction coefficient, however, is maintained at a value low enough that when there is no sheet between the friction member 48 and the conveyor 43, and retarding force will not overload the conveyor so as to cause damage to the power source driving the conveyor or to cause chattering or erratic movement of the conveyor belts.

With the above description in mind, many and varied obvious modifications of the present invention will become readily apparent to those of ordinary skill in the art.

Therefore, what is claimed is:

1. Apparatus comprising conveyor means of substantial breadth for conveying a sheet stack along a sheet-feed path, means for separating the bottom sheet of the stack and for feeding it individually along the sheet-feed path, comprising a friction member including surface means for arresting the stack and for frictionally engaging the surface of the sheet being separated and conveyed along said sheet-feed path, said friction member extending substantially transverse to the sheet-feed path and having a breadth substantially equivalent to that of the conveyor, means for exerting a predetermined force on said friction member for urging said friction member into engagement with the surface of said conveyor so that the friction member and the conveyor form a nip into which the sheet stack is fed, and means for supporting said friction member for floating universal movement at a predetermined location along the sheet-feed path such that the friction member can exert uniform pressure across the conveyor means.

2. Apparatus as set forth by claim 1 wherein said means for supporting said friction member comprises an elongate arm, means for connecting a first end of said arm to said friction member, and means for connecting the other end of said arm to a fixed support for universal movement relative thereto.

3. Apparatus as set forth in claim 2 in which the said fixed support is positioned above said sheet-feed path downstream from said friction member.

4. Apparatus as set forth in claim 2 wherein said means for urging said friction member into engagement with said conveyor comprises downwardly acting spring means.

5. Apparatus as set forth in claim 2, wherein said means for connecting the other end of said arm to the fixed support comprises a fixed shaft mounted above said feed path, and the other end of said arm having a hole extending therethrough and encircling said shaft, said hole having a size which is sufficiently greater than the exterior dimensions of the shaft that the arm can tilt relative thereto to allow a universal movement to said friction member.

6. Apparatus as set forth in claim 1 wherein said friction member comprises a cylindrical weight surrounded by a cylindrical sleeve of a material having an appropriate coefficient of friction.

7. Apparatus comprising a conveyor for feeding a sheet stack along a sheet-feed path and comprising a plurality of belts in close parallel array with their active surfaces lying in a common plane, a sheet separator member having a friction surface for separating the bottom sheet from a stack on the conveyor and means for urging said friction surface into engagement with the surface of said conveyor, said conveyor including a first number of belts of a material having a first coefficient of friction and a second number of belts of a different material having a second coefficient of friction which is different from said first coefficient of friction, said belts being so selected as to provide a conveyor surface having a desired mean coefficient of friction with paper which is higher than the coefficient of friction of said friction surface.

8. Apparatus as set forth in claim 7 wherein said first number of belts are formed of neoprene rubber and said second number of belts are formed of neoprene rubber and said second number of belts are formed of silicone rubber.

9. Apparatus as set forth in claim 7 in which the belts of higher friction coefficient are arrayed adjacent the margins of the conveyor and the belts of lower friction coefficient are arranged centrally of the conveyor.

10. Apparatus comprising a conveyor for feeding a sheet stack along a sheet-feed path and comprising a plurality of parallel belts, a sheet separator member having a friction surface for separating the bottom sheet from a stack on the conveyor, said sheet separator member extending transversely of said sheet-feed path, and substantially spanning said conveyor, means for urging said friction surface into engagement with the surface of said conveyor, and means for supporting said separator member for universal movement at a predetermined location along the sheet-feed path such that the separator member can exert uniform pressure across the conveyor, said conveyor including a first number of belts of material having a first coefficient of friction and a second number of belts of a material having a second coefficient of friction which is different from said first coefficient of friction, said belts being so selected as to provide a conveyor surface having a desired mean coefficient of friction with paper which is higher than the coefficient of friction of said friction surface.

* * * * *

UNITED STATES PATENT AND TRADEMARK OFFICE

CERTIFICATE OF CORRECTION

PATENT NO. : 3,984,095

DATED : October 5, 1976

INVENTOR(S) : Robert E. Zimmer

It is certified that error appears in the above-identified patent and that said Letters Patent are hereby corrected as shown below:

| | |
|---|---|
| Col. 3, lines 34, 35 | "feed path and which lies in a plane substantially normal to the" should be deleted. |
| Col. 6, lines 42, 43 and 44 (Claim 8, lines 2, 3 and 4) | "and said second number of belts are formed of neoprene rubber" should be deleted. |

Signed and Sealed this

Eighth Day of February 1977

[SEAL]

*Attest:*

RUTH C. MASON
*Attesting Officer*

C. MARSHALL DANN
*Commissioner of Patents and Trademarks*